US007592530B2

(12) United States Patent
Chang

(10) Patent No.: US 7,592,530 B2
(45) Date of Patent: Sep. 22, 2009

(54) NOISE-ELIMINATING FELT HAMMER

(75) Inventor: Fon-Ming Chang, Xizhi (TW)

(73) Assignee: Hong Cheng International Co., Ltd., Xizhi, Taipei County (TW)

( * ) Notice: Subject to any disclaimer, the term of this patent is extended or adjusted under 35 U.S.C. 154(b) by 0 days.

(21) Appl. No.: 12/185,075

(22) Filed: Aug. 2, 2008

(65) Prior Publication Data

US 2009/0211402 A1 Aug. 27, 2009

(30) Foreign Application Priority Data

Feb. 22, 2008 (TW) ..... 97203109 U

(51) Int. Cl.
*G10D 13/02* (2006.01)

(52) U.S. Cl. ..... 84/422.4

(58) Field of Classification Search ..... 84/422.4; 446/418

See application file for complete search history.

(56) References Cited

U.S. PATENT DOCUMENTS 1,892,886 A * 1/1933 Haight ..... 84/422.4
6,307,138 B1 * 10/2001 Simpson ..... 84/422.4

* cited by examiner

*Primary Examiner*—Kimberly R Lockett
(74) *Attorney, Agent, or Firm*—Pai Patent & Trademark Law Firm; Chao-Chang David Pai

(57) ABSTRACT

A felt hammer that may eliminate noise is provided, in which a grab handle is connected to a hammerhead; an elastic ring bush is wrapped around the circumference of the hammerhead; and a plurality of projecting nails are provided on the surface of the ring bush. Animal hair/wool strands are further wrapped around the ring bush backward and forward to clamp a basic wrap layer of animal hair/wool strands into the gaps between the projecting nails, and then fully wrapped to form a felt layer around the hammerhead and the ring bush. Thus, the hammer specialized for a Xylophone or a Marimba is formed, and when the hammer strikes, noise caused by the animal hair/wool strands rubbing each other may be eliminated for achieving a mellow and mild timbre.

7 Claims, 4 Drawing Sheets

NOISE-ELIMINATING FELT HAMMER

BACKGROUND OF THE INVENTION (a) Field of the Invention

This invention relates to a felt hammer that may eliminate noise and particularly to a felt hammer the structure of which is improved for a Xylophone or a Marimba.

(b) Description of the Prior Art

Xylophone and Marimba are percussion instruments, in which a specific hammer is used to strike acoustic disks, and a resonance pipes at the bottom is used to give off tune. A conventional hammer is roughly classified into a plastic hammer, a wooden hammer, and a felt hammer, and different tone colors are created when the hammer strikes; the former two hammers, the plastic one and the wooden one, are used to hammer the acoustic disks; however, although giving clear and crisp timbre, the high-class wooden acoustic disks are more easily damaged. The felt hammer is covered with a layer of felt that is wrapped by wool strands for producing a mellow and mild timbre. However, the wool strands are wrapped around the conventional felt hammer and are further bound for fixing. Thus, when the hammer repeatedly hammers the acoustic disks of the Xylophone or Marimba, as shown in FIG. 6, each strand of wool 10 can easily loosen and slide so that the tone quality deviates at the time of hammering; at the instant of hammering, noise is caused by the wool strands rubbing each other, which is particularly the case when the tone is given by the resonance pipe of the Xylophone. If such occurs, there is imperfection in the timbre and tone quality at the time of performance.

Consequently, because of the technical defects described above, the applicant has through experience and research developed the present invention, which can effectively improve the defects described above.

SUMMARY OF THE INVENTION

This purpose of this invention is mainly to provide an improved felt hammer that may eliminate noise. With the improved structure of hammer, the animal hair/wool strands in the felt layer are securely fixed for preventing the noise made when the acoustic disks are hammered and for achieving a mellow and mild timbre.

From the object mentioned above, according to this invention, the structure comprises a grab handle, a hammerhead, a ring bush, and a felt layer. The hammerhead is plastic and combined with an end of the grab handle. The ring bush is made of elastic plastics, the surface of which is formed with a plurality of projecting nails which are arranged around the hammerhead. The felt layer is formed by the animal hair/wool strands that wrap backward and forward around the hammerhead and the ring bush, in which the animal hair/wool strands in the basic wrap layer is located in gaps between the protruding nails. Thus, the felt hammer specialized for the Xylophone or Marimba is formed.

As a result, the animal hair/wool strands in the basic wrap layer are securely located in the gaps between the projecting nails. Thus, the noise caused by the animal hair/wool strands rubbing each other may be eliminated for achieving a mellow and mild timbre.

DETAILED DESCRIPTION OF THE PREFERRED EMBODIMENTS

Now, the present invention will be described more specifically with reference to the following embodiments. It is to be noted that the following descriptions of preferred embodiments of this invention are presented herein for purpose of illustration and description only; it is not intended to be exhaustive or to limit the invention to the precise form or structure disclosed.

With reference to the figures, a felt hammer that may eliminate noise according to this invention is particularly used for a Xylophone or a Marimba, mainly comprising a grab handle 1, a hammerhead 2, a ring bush 3, and a felt layer 4.

Figure 1:
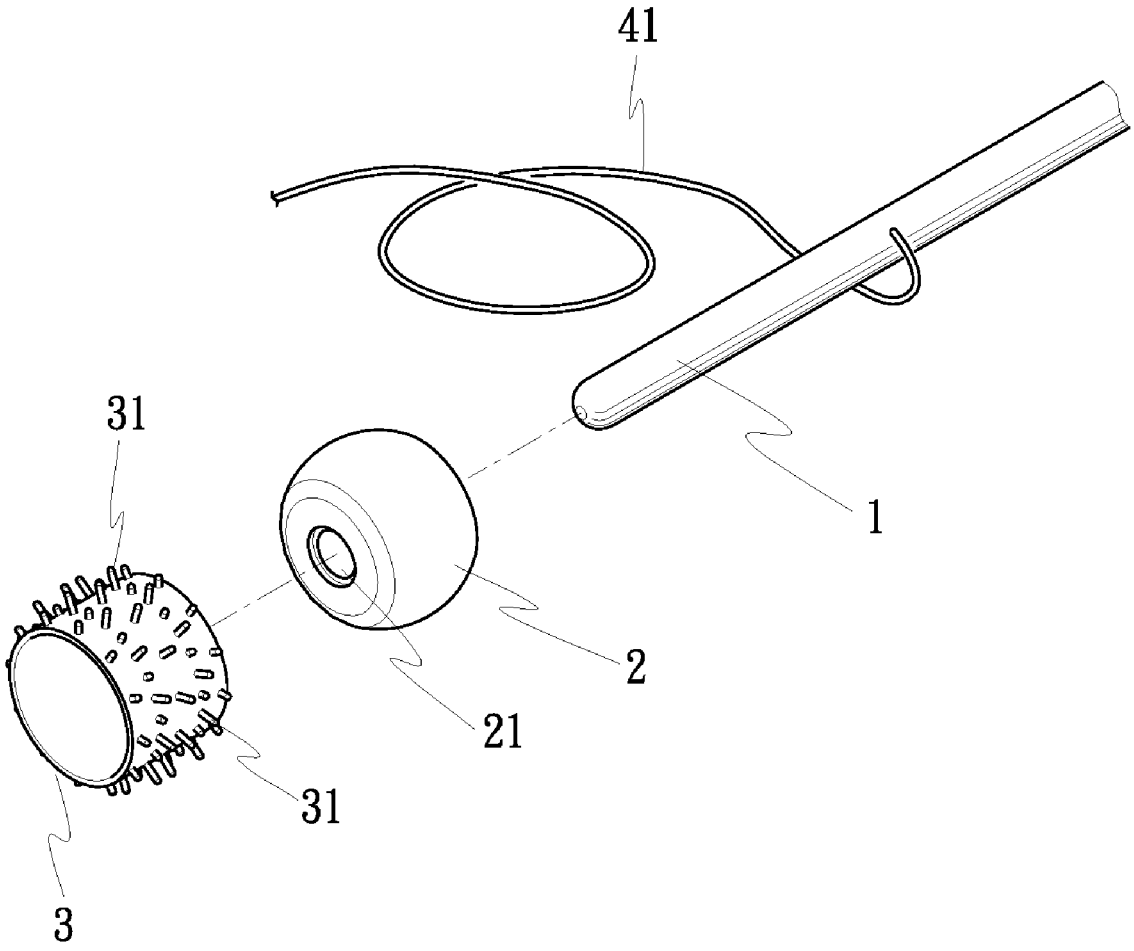
FIG. 1 is a 3D exploded view of a hammer according to this invention.
Figure 2:
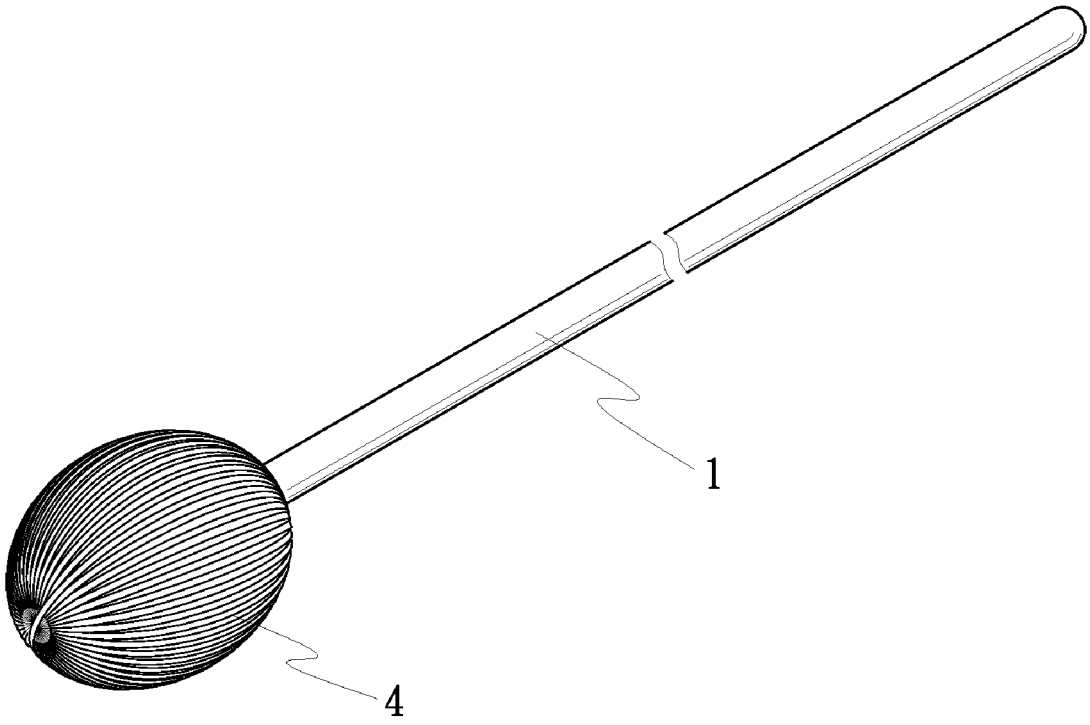
FIG. 2 is a 3D assembly view of the hammer according to this invention.

The grab handle 1, as shown in FIGS. 1 and 2, is a long rod made of a wood or another material, an end of which is connected to the hammerhead 2.

Figure 3:
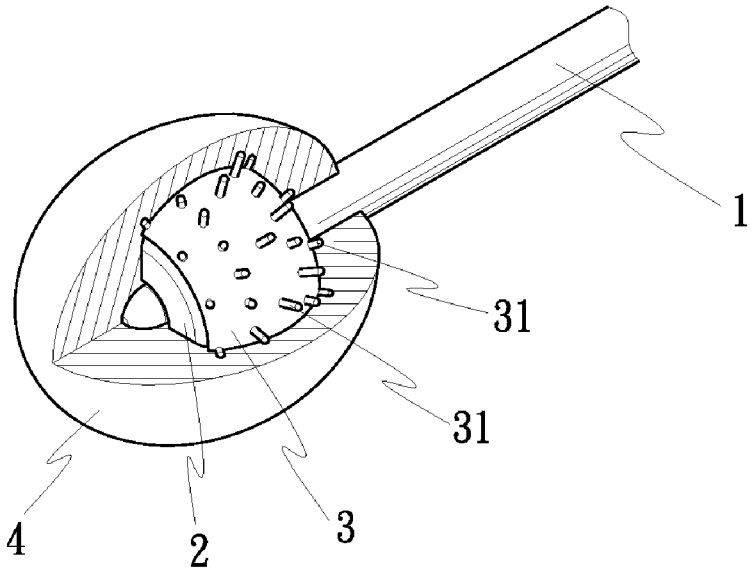
FIG. 3 is a 3D sectional view of the assembled hammer according to this invention.
Figure 4:
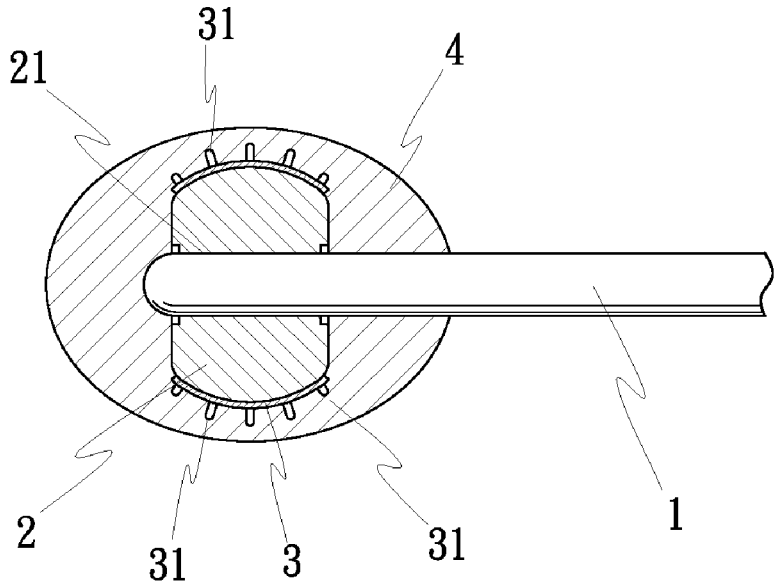
FIG. 4 is a sectional view of the assembled hammer according to this invention.

The hammer 2, as shown in FIG. 1, is a plastic part in the form of spheroid or cylinder or in another form, the center of which is formed with a thru hole 21 through which the hammer 2 is tightly set around the end of the grab handle 1, as shown in FIGS. 3 and 4.

The ring bush 3, as shown in FIG. 1, is made of an elastic rubber or plastic material, having an inner diameter slightly smaller than the outer diameter of the hammerhead 2, and a plurality of projecting nails 31 provided around its outer surface. The projecting nails 31 may be in the form of cylinder and sized preferably in diameter of around 1 mm and length of around 3 mm. Furthermore, preferably the plurality of projecting nails 31 are arranged in 5 rows on the surface of ring bush 3, in which each row of projecting nails 31 are arranged around the circumference of the ring bush 3, the length of each of the projecting nails at rows 1 and 5 on two sides of the surface of the ring bush 3 is about 2 mm, and the projecting nails 31 at rows 2 and 4 are staggered in two lengths which are about 3 mm and 1.5 mm. With the ring bush 3 that flexibly ties up the hammerhead 2, as shown in FIGS. 3 and 4, the projecting nails 31 is made to be distributed around the circumference of hammerhead 2.

Figure 5:
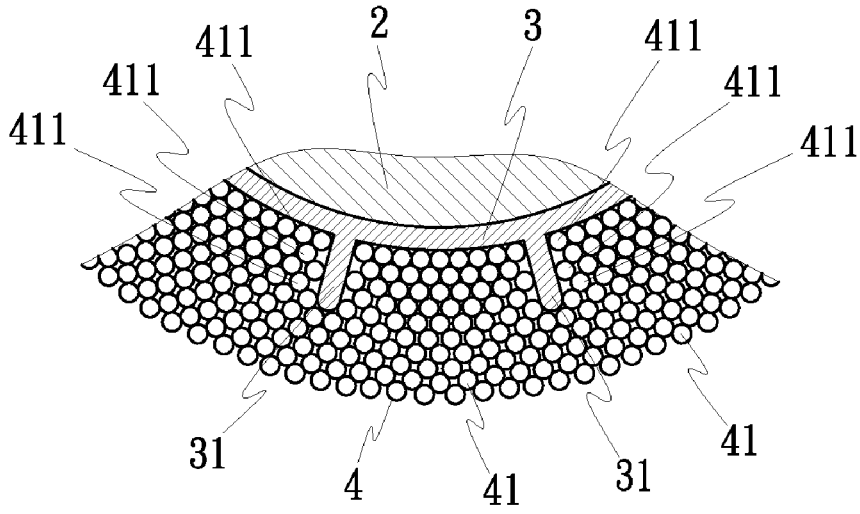
FIG. 5 is an enlarged sectional view of the assembled hammer according to this invention.
Figure 6:
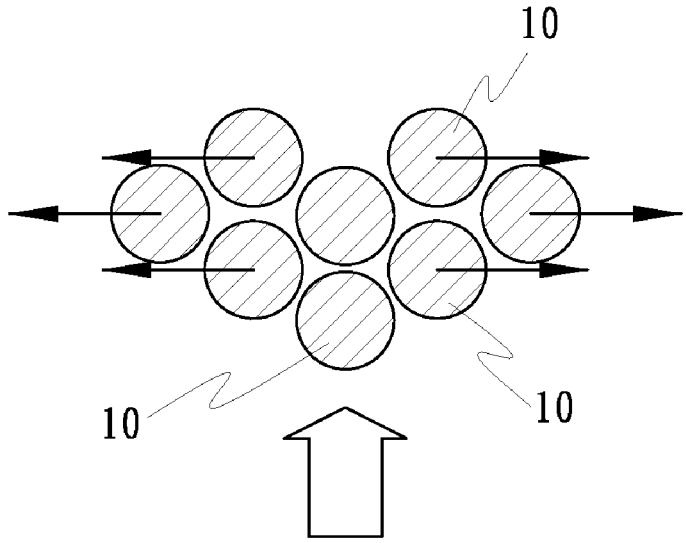
FIG. 6 (PRIOR ART)
FIG. 6 is a sectional view of the arrangement of conventional wool strands for the hammer.

The felt layer 4, as shown in FIGS. 1, 3, and 4, is formed with animal hair/wool strands 41 wrapping around the hammerhead 2 and the ring bush 3. The animal hair/wool strands 41 are preferably formed of sheep wool and are wrapped for 12 cycles on average around the circumference of hammerhead 2 and ring bush 3 for one layer and further wrapped for accumulated 8 layers through 12 layers, making the felt layer 4 to be formed as a shuttle and making the basic wrap layer 411 of animal hair/wool strands 41 to be located in the gaps between the projecting nails 31, as shown in FIG. 5.

When the grab handle 1, the hammerhead 2, the ring bush 3, and the felt layer 4 are assembled, the felt hammer specialized for the Xylophone or Marimba is formed. The projecting nails 31 are provided on the surface of ring bush 3 to clamp the basic wrap layer 411 of animal hair/wool strands on the felt layer 4, as shown in FIGS. 3 through 5, making the wrapping animal hair/wool strands 41 airtight and securely fixed. Thus, when the felt hammer strikes, noise caused by the animal hair/wool strands rubbing each other may be eliminated. Furthermore, with the designed ring bush 3 and felt layer 4 working with each other, when the acoustic disks of the Xylophone or Marimba are hammered, a mellow and mild timbre may be achieved.

It is stressed that the strands 41 can be formed of sheep wool or other types of wool in the broader sense of the word (namely, not limited to sheep wool). In fact, most animal hair can be used to form the strands 41, While the invention has been described in terms of what is presently considered to be the most practical and preferred embodiment, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A noise-eliminating felt hammer, comprising:

a grab handle;

a hammerhead connected with an end of the grab handle;

a ring bush set around the hammerhead, the surface of which is formed with a plurality of projecting nails that are arranged around the circumference of the ring bush; and a felt layer formed with animal hair or wool strands wrapping around the hammerhead and the ring bush, so that the animal hair or wool strands run through gaps between the protruding nails before the animal hair or wool strands wrap over the protruding nails.

2. The noise-eliminating felt hammer according to claim 1, wherein the ring bush is made of rubber.

3. The noise-eliminating felt hammer according to claim 1, wherein the ring bush is made of an elastic plastic.

4. The noise-eliminating felt hammer according to claim 1, wherein the plurality of projecting nails are arranged in 5 rows on the surface of the ring bush, in which each row of the projecting nails is arranged around the circumference of the ring bush, the length of each of the projecting nails that are arranged at rows 1 and 5 on two sides of the surface of the ring bush is about 2 mm, and the projecting nails at rows 2 and 4 are staggered in two lengths which are about 3 mm and 1.5 mm.

5. The noise-eliminating felt hammer according to claim 1, wherein the animal hair or wool strands on the felt layer wrap an average of 12 cycles around the circumference of the hammerhead and the ring bush for one layer and preferably wrap for a total of 8 layers through 12 layers.

6. The noise-eliminating felt hammer according to claim 1, wherein the animal hair or wool strands are preferably sheep wool strands.

7. The noise-eliminating felt hammer according to claim 1, wherein a thru hole is formed in the center of the hammerhead so that the hammerhead is tightly set around the end of the grab handle.

* * * * *